US007565791B2

(12) United States Patent
Itaya

(10) Patent No.: US 7,565,791 B2
(45) Date of Patent: Jul. 28, 2009

(54) WIRE ROPE FOR HEAVY DUTY HOISTING AND METHOD FOR MAKING SAME

(75) Inventor: Noboru Itaya, Northbrook, IL (US)

(73) Assignee: Pioneer Cable Corporation, Northbrook, IL (US)

( * ) Notice: Subject to any disclaimer, the term of this patent is extended or adjusted under 35 U.S.C. 154(b) by 149 days.

(21) Appl. No.: 11/820,441

(22) Filed: Jun. 19, 2007

(65) Prior Publication Data

US 2008/0314016 A1 Dec. 25, 2008

(51) Int. Cl.
*D02G 3/22* (2006.01)

(52) U.S. Cl. ..... 57/237; 57/241

(58) Field of Classification Search ..... 57/237, 57/241

See application file for complete search history.

(56) References Cited

U.S. PATENT DOCUMENTS

| | | | | | |
|---|---|---|---|---|---|
| 315,077 | A | | 4/1885 | Seale | |
| 3,240,570 | A | * | 3/1966 | Grimes, Jr. et al. | 57/214 |
| 3,824,777 | A | | 7/1974 | Riggs | |
| 4,022,010 | A | * | 5/1977 | Gladenbeck et al. | 57/231 |
| 4,197,695 | A | * | 4/1980 | Hughes et al. | 57/7 |
| 4,509,319 | A | | 4/1985 | Yoshida et al. | |
| 4,624,097 | A | * | 11/1986 | Wilcox | 57/232 |
| 4,887,422 | A | * | 12/1989 | Klees et al. | 57/220 |
| 5,386,683 | A | | 2/1995 | Misrachi | |
| 5,475,973 | A | * | 12/1995 | Furukawa et al. | 57/232 |
| 5,669,214 | A | | 9/1997 | Kopanakis | |
| 6,164,053 | A | * | 12/2000 | O'Donnell et al. | 57/232 |
| 6,360,522 | B1 | | 3/2002 | Walton | |
| 7,137,483 | B2 | | 11/2006 | Kato et al. | |
| 7,389,633 | B2 | | 6/2008 | Misrachi | |
| 2003/0089551 | A1 | * | 5/2003 | Kato et al. | 182/1 |

FOREIGN PATENT DOCUMENTS

| | | |
|---|---|---|
| JP | 2876140 | 11/1991 |

* cited by examiner

*Primary Examiner*—Shaun R Hurley
(74) *Attorney, Agent, or Firm*—William P. Oberhardt, LLC

(57) ABSTRACT

A wire rope has an independent wire rope core including lubricated individual core wires that are encapsulated in a tubular sheath of elastomeric or polymeric material surrounding the core wires and retaining the lubricant. A plurality of strands are located radially outwardly from and adjacent to the core. Each of the strands include strand wires that are lubricated. The strand wires are encapsulated in a tubular sheath of elastomeric or polymeric material that retain the lubrication for the strand wires. The core and strand encapsulating materials prevent direct metal-to-metal contact between core wires and strand wires, and between strand wires of adjacent strands. The core and strand encapsulating materials are applied in a manner so as to avoid loss of lubricant. Retaining lubrication and preventing direct metal-to-metal contact significantly improves the useful life of the wire rope.

39 Claims, 4 Drawing Sheets

WIRE ROPE FOR HEAVY DUTY HOISTING AND METHOD FOR MAKING SAME

BACKGROUND OF THE INVENTION

1. Field of the Invention

The present invention relates to wire ropes used for heavy duty hoisting applications. The wire rope of the invention finds particular utility in large excavating equipment used, for example, in mining. Wire ropes are employed, for example, in the hoisting apparatus for large electric shovels or dragline applications in mining operations.

The present invention relates to a design for a wire rope with an improved strength over time and a longer useful life as a result of decreased wear, metal fatigue and corrosion compared to prior designs for wire ropes. The improved useful life resulting from the design of the present invention results in significantly reduced maintenance costs associated with wire rope replacement in, for example, electric shovel or dragline operations. The longer useful life of the present invention also has the advantage of keeping large, highly capital-intensive pieces of machinery, such as the large mining equipment in which the wire rope of the present invention is utilized, in use by significantly extending the time between replacement or maintenance operations and thereby reducing the average number of maintenance intervals required for a given period to maintain or replace the wire rope. This keeps the large equipment (such as mining equipment) productive longer and for a greater percentage of time, as compared to equipment using prior wire rope designs which require more frequent downtime to maintain or replace the wire rope.

By reducing wire rope deterioration due to wear, metal fatigue, abrasion due to contamination, strand breakage, or corrosion over time, the present invention enhances the safety of the operation of the large equipment utilizing the wire rope. For example, the reduction of wire rope deterioration reduces unexpected or premature failure of the wire rope in operation of the heavy machinery, which failure could lead to accidents, injuries, or deaths.

Furthermore and in addition to the advantages discussed above, particular embodiments of the present invention have added safety features as compared to prior wire rope designs. In one particular embodiment, for example, an optically transparent or translucent elastomeric or polymeric material is utilized for encapsulation of the strands and core of the wire rope, permitting enhanced visual inspection of wire rope strands, core, and component wires to visually observe the surface conditions of the strands, core, or component wires in the wire rope in order to determine whether they are broken, worn, corroded, contaminated, or otherwise deteriorated, for example, so as to determine whether the wire rope is in compliance with appropriate standards for continued use (see, e.g., Occupational Safety and Health Administration (OSHA) standards §§1926.550 and 1926.602, or Federal Specification RR-W-410E, as applied to worn or broken cores or strands of wire ropes). In yet another embodiment of the present invention, visibility of the wire rope may be optically enhanced by encapsulating the wire rope in elastomeric or polymeric material having high visibility coloring or reflective qualities such as those provided in ANSI/ISEA 107-1999 for worker's apparel. Visibility of wire rope in mining or manufacturing operations is important, especially because the equipment utilizing the wire rope is often, and in some cases is typically, operated in dark conditions (for example, at night, or in dark or confined spaces such as excavations or mines). Visibility of the wire rope is important both for purposes of proper operation of the heavy machinery and for safety reasons.

2. Brief Description of the Related Art

Prior designs for wire rope, when exposed to heavy duty applications such as mining or heavy construction operations, have shown a propensity for requiring relatively frequent maintenance, removal, and replacement. This frequent maintenance and replacement activity results in a number of expenses and other difficulties suffered by the user of the wire rope in such applications, including but not limited to: (1) the more frequent replacement cost of the wire rope itself; (2) the frequent (often daily) required lubrication of certain prior art wire ropes; (3) the more frequent downtime of a large piece of capital equipment using the wire rope, such as in electric shovel or dragline applications in mining operations, resulting in decreased productivity (the replacement of wire rope in a large electric shovel, for example, typically takes 5 to 8 hours, during which the shovel is idle and no production takes place); and (4) the large equipment utilizing the wire rope is not infrequently utilized in a remote or relatively inaccessible location, making maintenance and replacement more time-consuming and difficult, and generally more expensive.

It has consequently long been the goal of wire rope designers, manufacturers, and users to extend significantly the useful life of wire rope. This has become especially true as the applications in which wire ropes are used have become more rigorous. For example, in mining operations, large electric shovels used in the 1970s could typically lift up to 25 tons per shovelful, and utilized a wire rope having 1.5 to 1.75 inch diameters. Today, large electric shovels used in mining typically lift up to 100 tons per shovelful and often utilize wire ropes having 2.75 inch diameters. The larger diameter/heavier capacity wire rope, of course, is more expensive, and hence more expensive to replace or maintain. Thus, a wire rope having an extended useful life is more essential than before.

Wire rope designers, manufacturers, and users have utilized a number of approaches to attempt to extend the useful life of wire ropes. One technique for extending the useful life of wire rope is lubrication of the wire rope, with, for example, petrolatum. Lubrication was thought to extend the life of the wire rope by a number of mechanisms. First, lubrication would diminish the friction that would otherwise occur as a result of direct metal strand-to-strand or strand-to-core contact, such as would occur, for example, when a wire rope is bent. Lubrication would diminish strand or core wear, metal fatigue, and breakage caused by such contact within the wire rope. Second, lubrication of the metal strands and core would help diminish corrosion of the metal strands and core by helping to seal out corrosive elements, such as moisture, oxygen, or other corrosive elements or contaminants in heavy duty applications.

While lubrication proved somewhat useful, it had shortcomings. Lubrication would, over time, and over a relatively short time in some heavy duty applications, begin to wash or wear away from critical areas of the wire rope. This occurred for several reasons. First, in heavy duty applications where there was considerable rubbing between the metal strands and/or between the strands and the core of the wire rope, lubricant would eventually simply rub away. Second, because some petroleum lubricants such as petrolatum have a comparatively low melting point (petrolatum, for example, melts at about 97 to 140 degrees Fahrenheit, 36.11 to 60.00 degrees Celsius), friction within the wire rope, for example, when strands or the core rub during bending of the wire rope under loading, would heat the metal within the wire rope above the melting point of the lubricant, and the lubricant would melt and simply wash away, leaving a dry, uncoated wire rope, subject to frictional contact and corrosion, and hence, wear, deterioration, and eventual breakage. To compound matters further, the portion of the wire rope where the lubricant would rub or wash away earliest was often the same portion that was encountering some of the heaviest frictional contact during use. Thus, frequent re-lubrication was required to maintain and extend the life of the wire rope—indeed, in some heavy duty mining operations, the entire wire rope was required to be re-lubricated on a daily basis, adding significantly to maintenance and replacement costs, but even such frequent procedures would not prevent the wire rope from losing critical lubricant shortly thereafter.

A further problem with lubrication was that it would cause contaminants to stick to it. Some contaminants, such as abrasives or corrosive agents, when they adhered to the lubricant that was in turn coating the wire rope, would have a detrimental effect on the useful life of the wire rope, by causing wear or corrosion in the wire rope.

Another technique utilized for extending the useful life of wire rope was to impregnate the wire rope with thermoplastic. The goal of this technique was once again to avoid or minimize direct metal strand-to-strand contact, for example, when the wire rope was bent, diminishing strand or core wear breakage and thereby improving fatigue life. A further goal of this plastic coating resulting from thermoplastic impregnation was to seal the surface of the wire rope to inhibit corrosion resulting from exposure to moisture, oxygen, or other abrasive or corrosive elements found in heavy duty applications such as mining.

Once again, however, the results of such a wire rope treatment were not entirely satisfactory. Plastic impregnation occurred at elevated temperatures, therefore lubrication of the wire rope ordinarily needed to be avoided—the high temperatures required for thermoplastic impregnation resulted in a gas created by the lubricant, making plastic impregnation virtually impossible if the wire rope was previously lubricated. As a result, it became standard procedure to clean and de-grease the metal strands prior to plastic impregnation, and, consequently, the advantages of using lubricant on wire ropes were lost. (See, e.g., U.S. Pat. No. 3,824,777 at col. 1, lines 11-17).

Another issue arising with plastic impregnation was the inability to achieve even separation of the various component strands that made up the wire rope (see, e.g., U.S. Pat. No. 3,824,777 at col. 1, lines 17-21). During the course of fabrication of the wire rope, some of the strands and/or the core would move closer to one another than was called upon by the wire rope's design, and would sometimes even be in contact with one another at some locations, while other strands would have excess separation, making uniform plastic impregnation difficult, with the result being that the goals sought by such a process would not be fully achieved, and the useful life of the wire rope could not be extended as far as had been hoped.

To address these issues, U.S. Pat. No. 3,824,777 proposed a method of making a lubricated plastic impregnated wire rope. Heavy lubricant, such as petrolatum or asphalt based lubricant, was applied to component wires as the wires were formed into strands (the petrolatum would be applied cold, while the asphalt based lubricant would be applied hot). The lubricated wire was then preheated to about 100 degrees to 275 degrees Fahrenheit (37.78 to 135.00 degrees Celsius) and preferably 120 degrees to 160 degrees Fahrenheit (48.89 to 71.11 degrees Celsius), a temperature range in which the lubricants would not turn to gas during the later step of plastic impregnation. The lubricated wire rope was then kept at a balanced strand separation with a "strand gap controller" while being impregnated by an extruded thermoplastic at about 2,000 pounds per square inch ($13.79\times10^6$ pascals) to 4,000 pounds per square inch ($27.58\times10^6$ pascals) into the interstices of the rope.

One adverse result of making a wire rope as described in U.S. Pat. No. 3,824,777, however, was that impregnation of the wire rope with thermoplastic at high pressures via the extrusion process resulted in the plastic constraining the interior movement of the strands of the wire rope. In other words, because of the plastic impregnation, the strands of the wire rope could not readily move relative to each other. Such relative movement is desirable, and indeed necessary, for example, when the wire rope bends, especially under heavy loading. Constraining the strands and restricting their relative movement caused the strands to be strained and fatigued, resulting in premature failure of the strands, and thus the wire rope.

Another issue arising with wire rope made according to U.S. Pat. No. 3,824,777 was loss of lubricant resulting in sections having dry wire rope. While the manufacturing process for such wire rope was below the boiling points of the lubricants, and avoided the problem of applying plastic to wire when the lubricant was turned to a gas, preheating of the wire was often above the melting point of the lubricants, which resulted in much of the lubricant washing off during the plastic impregnation step of the process. The relatively high pressures utilized for plastic impregnation further contributed to lubricant wash off.

The wire rope made as set forth above, while accomplishing some desirable goals, nevertheless had significant shortcomings in terms of improved useful life. For example, it was found that wire ropes made as set forth above had a typical useful life, when used in heavy duty hoisting operations in the 1970s, of 423 to 776 hours, meaning that the wire rope required replacement approximately every 21.1 to 38.8 days of normal operations. Moreover, by the mid-1980s, larger electric shovels, with scoops having a capacity of 65 tons, were being introduced, for example, in mining operations, adding further impetus to the desire for an improved wire rope.

U.S. Pat. Nos. 4,509,319 and 6,360,522 attempted to address some of the shortcomings of prior wire ropes by introducing plastic inserts into the lubricated wire rope design. In these designs, strips of plastic filler material were inserted into the interstices between the central independent wire rope core and the individual outer strands of the wire rope, before closing and helically twisting the combined metal strands and plastic filler strips to form the finished wire rope. Different variations of plastic strips were employed. For example, U.S. Pat. No. 4,509,319 utilized reinforcing cores in the plastic filler elements, while U.S. Pat. No. 6,360,522 utilized different shaped plastic filler elements that sought to reduce vibration of the wire rope, wherein the plastic filler material had a bi-directionally oriented molecular structure to provide relatively higher tensile strength and high elasticity.

As the conditions encountered by wire rope applications continued to increase in terms of difficulty, further improvements in wire rope design became even more desirable. For example, in approximately 1998, 100 ton capacity large electric shovels were introduced into mining operations. Wire rope of the type disclosed in U.S. Pat. No. 6,360,522 was used on this type of shovel, and was observed to have an average useful life of approximately 920 hours. These large shovels were being typically operated three shifts per day, seven days per week (with the exception of downtime for meals, repairs, or breaks), or approximately an average of 20 hours per day for 360 days per year. Consequently, each set of wire ropes used in the hoisting apparatus for these large electric shovels would be required to be changed, on average, approximately 7.83 times per year. As stated previously, replacement of a set of wire ropes required approximately 5 to 8 hours, during which the large electric shovel was idle and thus unproductive, resulting in a substantial cost to the operator of the shovel.

Inspection of the spent wire-ropes made according to U.S. Pat. Nos. 4,509,319 and 6,360,522 showed that while wash off of the lubricant was reduced compared to some prior art wire ropes, it was not eliminated, because the surfaces of the strands and central core were partially exposed, permitting loss of lubricant, especially in stressful bending under heavy loads. Partial exposure of the metal strands in these wire rope designs also permitted contamination by moisture, abrasives, corrosive agents, and oxygen, and was believed to be another cause of premature deterioration and failure of the wire rope. It was also true that strand-to-strand and strand-to-core metal-to-metal contact, while reduced in these designs, was still significantly present, and was believed to be a factor in the reduction in useful life and ultimate failure of wire ropes made in these manners.

In view of the fact that large 100 ton electric shovels within which the wire ropes are utilized are becoming more prevalent, especially in mining operations, it was desirable to find a way to improve upon the design of the wire ropes to increase, in an economical manner, the useful life of the wire ropes.

BRIEF SUMMARY OF THE INVENTION

In view of the foregoing, it is an object of the embodiments of the invention described herein to provide a high strength wire rope having a significantly improved useful life. It is, for example, an object of the described embodiments of the invention to provide a wire rope that requires replacement less frequently, especially in heavy duty hoisting applications, such as when used in the hoisting apparatus for large electric shovels or dragline usage in mining operations.

It is another object of the embodiments of the inventions described herein to provide a wire rope that is less expensive and more economical to use in heavy duty hoisting applications than prior art wire ropes.

It is yet another object of the described embodiments of the present invention to provide a design for a wire rope that better resists corrosion for longer periods as compared to prior art wire ropes, thereby helping to improve the wire rope's useful life.

It is a further object of the embodiments of the invention described herein to resist or reduce direct metal-to-metal contact between strands of the wire rope, and between the strands and core of the wire rope, for longer periods of time, especially in heavy duty hoisting applications, as compared to prior art wire ropes, thus helping to improve the useful life of the wire rope.

Yet another object of the described embodiments of the invention is to provide a wire rope having plastic elastomeric or polymeric lubricated strand and core elements that retain lubrication for a longer time compared to prior art wire ropes, thereby reducing corrosion, and also thereby reducing friction that would otherwise occur in bare metal-to-metal contact amongst the components within the wire rope, such as between adjacent strands of the wire rope, or such as between strands and the core of the wire rope, or such as between adjacent individual wires within the strands or core of the wire rope. Such bare metal-to-metal contact is generally undesirable in wire ropes because it has the effect of causing the metal to wear, fatigue, or deteriorate within a wire rope, resulting in a shorter useful life. By retaining the lubrication and reducing the bare metal-to-metal contact, the useful life of the wire rope is improved. Retention of lubricant also avoids the frequent re-lubrication maintenance operations required for some prior art wire ropes. Retention of lubricant in the wire rope also avoids lubricant spills, further promoting a safer working environment.

A further object of the presently described embodiments of the invention is to provide a wire rope that does not unduly limit or constrain desired movement of the strands within the wire rope relative to each other or relative to the core of the wire rope (which results in unnecessary strain and metal fatigue), especially during bending under heavy loads.

It is yet another object of the described embodiments of the present invention to provide a wire rope that promotes better sealing of the metal strands, core, and component wires as compared to certain prior art wire ropes so as to reduce the amount of contaminants that contact the metal strands and wires. Contaminants, such as moisture, abrasives, corrosives, and air, separately or combined, can have a deleterious effect on the useful life of wire ropes; hence, preventing or reducing their contact can significantly improve the useful life of a wire rope.

It is a further object of the described embodiments to provide a method for manufacturing a wire rope that accomplishes the objects described above, wherein the process of manufacture is economical in nature.

Another object of one described embodiment of the invention is to encapsulate the component strands and/or core of the wire rope in optically transparent or translucent material in order to permit visual inspection of wire rope strands and core elements to determine whether the strands, core, or individual component wires are broken, worn, corroded, contaminated, or otherwise deteriorated, so as to determine whether the wire rope requires replacement in connection with appropriate standards, such as OSHA §§1926.550, 1926.602, or Federal Specification RR-W-410E, as they pertain to wire ropes. This has the advantage over certain prior art wire rope designs wherein the wire rope is impregnated with optically opaque plastics, usually colored an opaque color such as blue, which do not permit such visual inspections, and which require some other means (such as passage of a predetermined time after installation of the wire rope) for estimating in advance when removal of the wire rope is appropriate, which can lead to failure of the wire rope prior to removal, or conversely, premature removal of a wire rope that still has useful life left in it. Opaque plastic in prior art wire ropes effectively prevents inspection that would determine whether compliance with appropriate standards is present, and, in such instances, the wire rope must be cut and dismantled to determine whether it is or is not in compliance. Once the wire rope has been cut for inspection, however, that wire rope can no longer be used for its intended purpose.

A further object of a described embodiment of the invention is to encapsulate a wire rope in elastomeric or polymeric material having high visibility coloring or reflective elements such as those described in the context of worker's apparel in ANSI/ISEA 107-1999. High visibility of wire ropes is desirable both from the point of view of the operator of the heavy machinery utilizing the wire rope, and from a safety standpoint. Visibility enhancement is especially desirable because the wire rope is often operated in dark conditions, for example, at night, in deep excavations, or in mines.

The disclosed embodiments for the present invention achieve the aforementioned objects and others because they include features and combinations not found in prior art wire ropes or methods of making same.

In the described embodiments of the present invention, an improved wire rope having significantly improved useful life is provided, wherein the wire rope is lubricated, and wherein the independent wire rope core and outer strands each have elastomeric or polymeric tubular sheaths to prevent or diminish direct metal-to-metal contact between the individual component wires included in the core and the strands, or between the individual wires of adjacent strands, and wherein the sheaths preserve the lubricant within the core and strands. A lubricated independent wire rope core is provided wherein that independent wire rope core is not impregnated with elastomeric or polymeric material, but rather has a core that includes individual component wires that are combined, and then encapsulated in a tubular sheath of elastomeric or polymeric material in a manner so that the lubricant does not wash away, but rather is retained in the independent wire rope core.

A plurality of outer strands surround the independent wire rope core, and are twisted helically around the independent wire rope core. The strands include individual component wires that are combined, and then are also lubricated. The combined lubricated individual wires of each of the outer strands are also not impregnated, but rather are encapsulated in a tubular sheath of elastomeric or polymeric material in a manner so as to substantially retain the lubricant in the strands. The elastomeric or polymeric material is utilized for the sheaths surrounding the independent wire rope core and the outer strands preferably is an elastomeric or polymeric material having a high compressive strength, and most preferably has a minimum compressive strength of over approximately 7,000 pounds per square inch ($48.26\times10^6$ pascals). Elastomeric or polymeric materials possessing such properties include polypropylene, polyurethane, and polyester.

By individually encapsulating the lubricated individual core wires in the rope core and the lubricated individual strand wires of each of the outer strands in tubular sheaths of elastomeric or polymeric material, thereby retaining the lubricants for the individual strand wires and the individual core wires, the present invention overcomes the problems associated with prior art wire rope designs, with the result that the useful life of the wire rope of the present invention is extended significantly. The elastomeric or polymeric sheaths made of high compressive strength material individually encapsulating the individual component wires of the independent wire rope core and each of the outer strands help to extend the useful life of the wire rope by preventing or avoiding metal-to-metal contact amongst and between the individual component wires of the independent wire rope core and the outer strands. Because encapsulation of the core and the outer strands takes place in a manner so as to seal and retain the lubricant coating of the individual core wires and individual strand wires, lubrication is not washed off substantially during the manufacturing process. By substantially retaining lubricant, the wire rope's useful life is extended. Moreover, because the elastomeric or polymeric sheaths of encapsulation material surrounding the independent individual component wires of the wire rope core and the outer strands serve to seal the lubricant within the wire rope, the frequent (often daily) re-lubrication maintenance efforts and expenses required for certain prior art wire ropes are avoided. The sheaths of encapsulation material also help seal out the abrasive and corrosive contaminants and elements. All of this helps to extend the useful life of the wire rope. Moreover, because the independent wire rope core and strands are not impregnated with plastic, but rather the individual component wires of the core and strands are encapsulated in elastomeric or polymeric material, the core and strands are not constrained from interior movement relative to each other, but rather are permitted to move interiorly independently of one another. This is especially important when the wire rope is bent under a heavy load, and prevents or avoids straining and fatiguing the core and strands, avoiding premature deterioration of failure of the wire rope, and thus extending the useful life of the wire rope.

The elastomeric or polymeric sheaths of encapsulation material may be optically transparent or translucent, in some embodiments of the invention, in order to permit visual inspection of the wire rope to determine whether interior components of the wire rope (the core, the outer strands, or the individual wires making up the core or strands) are broken, worn, corroded, contaminated, or otherwise deteriorated, requiring wire rope replacement, for example, in connection with appropriate standards, such as OSHA §§1926.550, 1926.602, or Federal Specification RR-W-410E, as they pertain to wire ropes. A further embodiment of the invention includes elastomeric or polymeric sheaths of encapsulating material having high visibility coloring or reflective components so that the wire rope is more readily visible in use.

The invention also includes a method of making the improved wire rope. An independent wire rope core and a plurality of outer strands, all preferably made from steel wire, are coated with lubricant, such as petrolatum, preferably in a continuous in-line process with the core and strands being supplied from a substantially continuous source, such as a spool or bobbin on a stranding machine. The method preferably uses conventional planetary wire rope manufacturing equipment in-line with standard encapsulation equipment adapted for the manufacture of the strands and the independent wire rope core of the invention, further combined in-line with conventional planetary wire rope closing equipment for combining and closing the strands around the independent wire rope core at substantially constant tension. The lubricated independent wire rope core, and the surrounding strands, are all separately encapsulated in an elastomeric or polymeric sheath, wherein the elastomeric material is preferably a high compressive strength material, preferably having a minimum compressive strength over approximately 7,000 pounds per square inch ($48.26\times10^6$ pascals), such as polypropylene polyurethane, or polyester. The lubricated independent wire rope core and lubricated strands are encapsulated during manufacture in a manner that seals and thereby retains the lubrication of the individual core wires, and individual strand wires, respectively. The strands are arranged at regular intervals in a proper cross-sectional relationship around the independent wire rope core. The strands are closed about the independent wire rope core and twisted to form a helical system of outer strands surrounding the independent wire rope core.

DETAILED DESCRIPTION OF THE INVENTION

Figure 1:
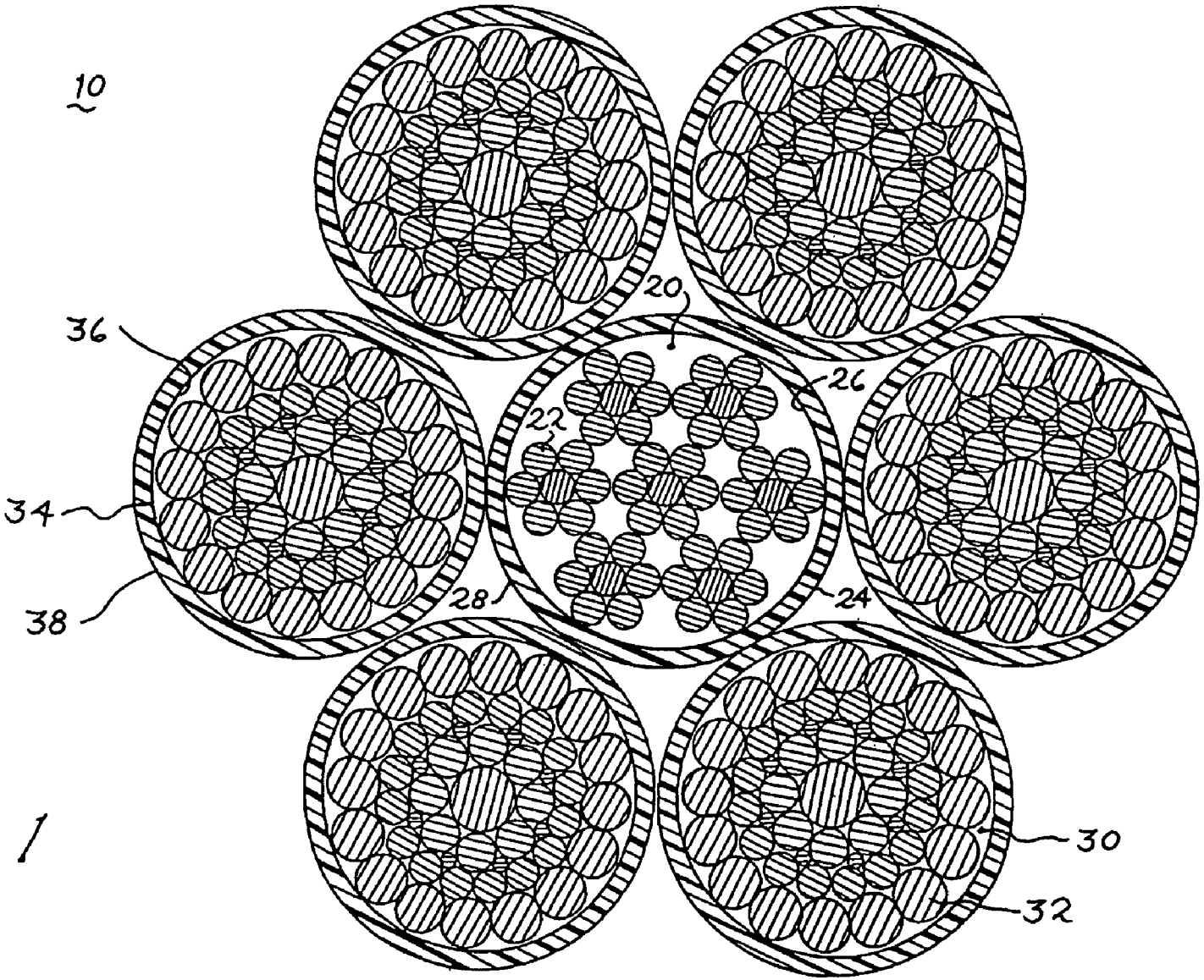
FIG. 1 is a cross-sectional view of an embodiment of a wire rope of the present invention.

Referring to FIG. 1, a wire rope 10 particularly suitable for heavy duty hoisting is provided that includes a plurality of components. An independent wire rope core 20 is located along the central axis of wire rope 10. Independent wire rope core 20 includes a plurality of individual core wires 22 that are preferably made of steel, and most preferably made of improved plow steel or extra improved plow steel. The individual core wires 22 included in the independent wire rope core 20 are preferably twisted together for added strength. The individual core wires 22 can be made of be bright round wire or compacted wire. The diameters of the independent wire rope core 20, and of the individual core wires 22 included in the independent wire rope core 20, may vary depending upon the contemplated end use of the wire rope 10. Similarly, the number of individual core wires 22 may vary depending upon this intended end use of wire rope 10.

The individual core wires 22 included in the independent wire rope core 20 are coated, and preferably thoroughly coated, with an appropriate lubricant (not illustrated), such as, preferably, petrolatum. The outer circumference of the combined individual core wires 22 coated with lubricant are substantially surrounded in a tubular sheath of elastomeric or polymeric core encapsulating material 24, with the core encapsulating material 24 being located radially outwards of the outer circumference of the combined individual core wires 22 coated with lubricant. The core encapsulating material 24 has an inner surface 26 and an outer surface 28. The core encapsulating material 24 substantially retains the lubricant associated with the individual core wires 22 of independent wire rope core 20, and substantially aids in preventing the lubricant from becoming disassociated from the individual core wires 22, such as by washing or rubbing off. As a consequence, the requirement of frequent re-lubrication of the independent wire rope core 20 of wire rope 10 of the present invention is avoided. Moreover, retention of lubricant in independent wire rope core 20 of wire rope 10 avoids lubricant spills, further contributing to a safer work environment.

The core encapsulating material 24 substantially seals the lubricated combined individual core wires 22, and thereby substantially aids in preventing the individual core wires 22 and the lubricant associated with the individual core wires 22 from becoming contaminated with, for example, abrasives or corrosive elements (not illustrated) that would serve to cause wear or corrosion of the individual core wires 22. Abrasives and corrosive elements are common in environments, such as mining operations, where wire ropes are often utilized. By diminishing contamination of the individual core wires 22 and associated lubricant by abrasives or corrosive elements, the useful life of the wire rope 10 of the invention is improved.

The core encapsulating material 24 is preferably made of an elastomer or polymer that has a high compression strength, and preferably has a compression strength of over approximately 7,000 pounds per square inch ($48.26\times10^6$ pascals). The thickness of the core encapsulating material 24, being the distance between the inner surface 26 and the outer surface 28 of the core encapsulating material 24, is relatively thin, and is preferably between approximately 1.0 mm and 3.6 mm (between approximately 0.0394 inches and 0.14184 inches) depending upon the selection of elastomeric or polymeric material, and depending upon the intended application for the wire rope 10.

The core encapsulating material 24 is applied to the outer diameter of the combined individual core wires 22 in a manner that promptly seals and thereby retains the lubricant associated with the individual core wires 22 in order to avoid or prevent substantial wash off or disassociation of the lubricant from the individual core wires 22. The core encapsulating material 24 surrounds the individual core wires 22, but is not applied at high pressure as in an impregnation process. By not applying the core encapsulating material 24 in a high pressure impregnation process, the present invention further avoids wash off or disassociation of the lubricant from the individual core wires 22 as a result of the application of and impregnation by plastic at high pressures.

Referring once again to FIG. 1, wire rope 10 includes a plurality of strands 30 located radially outwardly from and adjacent to independent wire rope core 20. Each strand 30 includes a plurality of individual strand wires 32. The individual strand wires 32 are not necessarily, but preferably are made of steel, and most preferably are made of the same grade of steel as are the individual core wires 22, namely, improved plow steel or extra improved plow steel. The individual strand wires 32 are preferably twisted together for added strength, and can be made of bright round wire or compacted wire. Once again, the diameters of strands 30, and of the individual strand wires 32 included in the strands 30, may vary depending upon the intended end use of the wire rope 10. In a similar manner, the number of individual strand wires may vary depending on the intended end use of the wire rope 10.

While the wire rope 10 includes a plurality of strands 30, the wire rope preferably includes six to eight strands 30 arranged at substantially the same radial distance from the central axis of wire rope 10, and preferably at substantially equal intervals from adjacent strands 30, as illustrated in FIG. 1.

Like the individual core wires 22, the individual strand wires 32 of each of the strands 30 are coated, and preferably thoroughly coated, with an appropriate lubricant (not illustrated), preferably petrolatum. The outer circumferences of the combined lubricated individual strand wires 32 for each of the strands 30, like the individual core wires 22, are surrounded in tubular sheaths of elastomeric or polymeric strand encapsulating material 34 having an inner surface 36 and an outer surface 38. The strand encapsulating material 34 substantially retains the lubricant associated with the individual strand wires 32 of each of the strands 30, and substantially aids in preventing the lubricant from becoming disassociated from the individual strand wires 32 in the same manner that core encapsulating material 24 aids in preventing the lubricant from becoming disassociated from the individual core wires 22. The strand encapsulating material 34 also substantially aids in preventing the individual strand wires 32 and the associated lubricant from becoming contaminated with abrasives and corrosive elements. Once again, by diminishing the disassociation of the lubricant from the individual strand wires 32, and by diminishing contamination by abrasives or corrosive elements of individual strand wires 32 and the lubricant associated therewith, the useful life of the wire rope is substantially improved, because wear, metal fatigue, corrosion, and strand breakage are reduced. In addition, maintenance of the wire rope 10 by re-lubrication is avoided, as are lubricant spills resulting from disassociation of the lubricant from the components of wire rope 10.

The strand encapsulating material 34, like the core encapsulating material 24, is preferably made of an elastomer or polymer having a high compression strength, and preferably has a compression strength of more than approximately 7,000 pounds per square inch ($48.26\times10^6$ pascals), such as polypropylene, polyurethane, or polyester. Most preferably, the strand encapsulating material 34 is made from the same elastomer or polymer as is the core encapsulating material 24. The distance between the inner surface 36 and the outer surface 38 of the strand encapsulating material 34 (the thickness of the strand encapsulating material 34) is preferably between approximately 1.0 mm 3.6 mm (between approximately 0.0394 inches and 0.14184 inches) depending upon what elastomeric or polymeric material is selected, and depending upon the intended use and environment of use for wire rope 10.

The strand encapsulating material 34 is applied to the outer circumference of the lubricated combined individual strand wires 32 in a similar manner as the core encapsulating material 24 is applied to the outer circumference of the lubricated combined individual core wires 22, that is, by encapsulating the lubricated combined individual strand wires 32 in a manner that promptly seals and thereby retains the lubricant associated with the individual strand wires 32 before the lubricant has a chance to wash away or become disassociated from the individual strand wires 32. In addition, the encapsulation occurs at a substantially lower pressure than is used in a high pressure encapsulation process, in order to avoid wash off or disassociation of the lubricant from the individual strand wires 32 during the manufacturing process.

Referring to FIG. 1, the plurality of strands 30 are arranged preferably at substantially equal intervals around the outer circumference of independent wire rope core 20, with the outer surfaces 38 of strand encapsulating material 34 of strands 30 contacting the radially outer surface 28 of core encapsulating material 24 of independent wire rope core 20. The strands 30 are closed around independent wire rope core 20, with the each of the strands 30 preferably being twisted helically around independent wire core 20, preferably in a regular manner having regular intervals.

Importantly, as can be seen in FIG. 1, the individual strand wires 32 of strands 30 do not contact the individual core wires 22 of independent wire rope core 20, nor do the individual strand wires 32 of any individual strand 30 contact the individual strand wires 32 of any other strand 30 in the wire rope 10. Instead, the outer surface 28 of core encapsulating material 24 of independent wire rope core 20 contacts the outer surfaces 38 of strand encapsulating material 34 of strands 30, and any individual strand 30 contacts an adjacent strand 30, if at all (such as, for example, during the bending of the wire rope 10, under a load), at the adjacent outer strand surfaces 38 of encapsulating material 34. Consequently, the core encapsulating material 24 of independent wire rope core 20 and the strand encapsulating material 34 of strands 30 serve to prevent direct metal-to-metal contact between individual core wires 22 and individual strand wires 32, on the one hand, or between the individual strand wires 32 of an individual strand 30 and the individual strand wires 32 of an adjacent strand 30, on the other hand. By preventing or avoiding the direct metal-to-metal contact as described above, wear, fatigue, breakage, or deterioration of the individual core wires 22 and individual strand wires 32 is significantly diminished, and the useful life of wire rope 10 is further improved.

Also importantly, the wire rope 10 of the present invention does not employ plastic impregnation at high pressures that has, in prior art wire ropes, constrained movement of independent wire rope core 20 relative to strands 30. Instead, the present invention surrounds the individual core wires 22 in elastomeric or polymeric core encapsulating material 34 which permits, for example, lateral movement of the independent wire rope core 20 and individual core wires 22 relative to the strands 30 and individual strand wires 32 (or the lateral movement of one strand 30 and individual strand wires 32 relative to a different strand 30 having different individual strand wires 32), by allowing some movement or slippage of the strand encapsulating material 34 against and relative to the core encapsulating material 24 (or relative to the strand encapsulating material 34 of a different strand 30), all the while preventing or avoiding direct metal-to-metal contact or friction between the individual strand wires 32 and individual core wires 22 (or between the individual strand wires 32 of one strand 30 and the individual strand wires 32 of an adjacent strand 30) because of the intervening strand encapsulating material 34 and/or core encapsulating material 24. By avoiding the constraint of movement of the individual strand wires 32 relative to the individual core wires 22 (or relative to other individual strand wires 32 of different strands 30), and by permitting relative movement between them as accomplished in the present invention, strain and metal fatigue that otherwise would occur in wire rope 10 if the strands 30 and independent wire rope core 20 were constrained relative to each other, especially when wire rope 10 is bent and sustaining heavy loading conditions, is significantly reduced, thereby diminishing strain and metal fatigue. Consequently, premature failure of the wire rope is avoided, and the average useful life of the wire rope 10 is further improved significantly.

The strand encapsulating material 34 and/or the core encapsulating material 24 may be made from optically transparent or translucent elastomer or polymer to permit visual inspection of the individual core wires 22 and individual strand wires 32 of wire rope 10. Polyester is an especially useful material that may be utilized for strand sheathing material 34 and core sheathing material 24 in such cases, because polyester has the advantage of being a clear resin. Visual inspection of the wire rope 10 may reveal, for example, that individual strand wires 32 (or individual core wires 22) are broken, worn, corroded, contaminated, or otherwise deteriorated, or that failure of the wire rope 10 is imminent. Visual inspection can thus be utilized to determine whether the wire rope 10 complies with appropriate standards for continued use, such as OSHA §§1926.550, 1926.602, or Federal Specification RR-W-410E, as they pertain to wire ropes. Moreover, visual inspection can be accomplished without cutting wire rope 10 and dismantling it for inspection, as is required in certain other prior art wire ropes, after which the prior art wire ropes ordinarily are unable to be used again for their intended purpose. The optically transparent or translucent elastomer or polymer thus serves a safety function, by allowing visual inspection to detect that wire rope 10 requires replacement prior to a failure that could cause equipment damage, accidents, injuries, or even death.

Conversely, visual inspection of the wire rope 10 that is scheduled for removal from the equipment on which it is mounted which has optically transparent or translucent strand encapsulating material 34 and/or core encapsulating material 24 may reveal that there is no or minimal individual strand wires 32 (or individual core wires 22) that are broken, worn, corroded, contaminated, or otherwise deteriorated, and that may, in the judgment of the owner/operator of the equipment utilizing wire rope 10, permit an extended use of wire rope 10, thus achieving a further economic savings as a result of the resulting extended use.

The strand encapsulating material 34 and/or the core encapsulating material 24 may also be made from elastomeric or polymeric material having high visibility coloring and/or which incorporates reflective components so that the wire rope is more readily visible during use. An example of such high visibility coloring that may be utilized is fluorescent lime-yellow, a color commonly specified, for example, in safety vests in work environments due to its highly visible nature, particularly in low light conditions. (See, for example, ANSI/ISEA 107-1999). As previously discussed, because wire rope 10 may be and often is utilized in relatively dark conditions (for example, at night, in excavations, or in mines), enhancement of the ability to see wire rope 10 during operation of (especially) heavy machinery is important both from the perspective of proper operation of the equipment, and for safety reasons. Strand encapsulating material 34 and core encapsulating material 24 may also be made from elastomeric or polymeric material that is both translucent for visual inspection and incorporates high visibility coloring and/or reflective components for visual enhancement of the wire rope 10 of the invention.

A preferred in-line process for manufacturing the wire rope 10 of the invention is described below and illustrated in FIGS. 2, 3, and 4.

Figure 2:
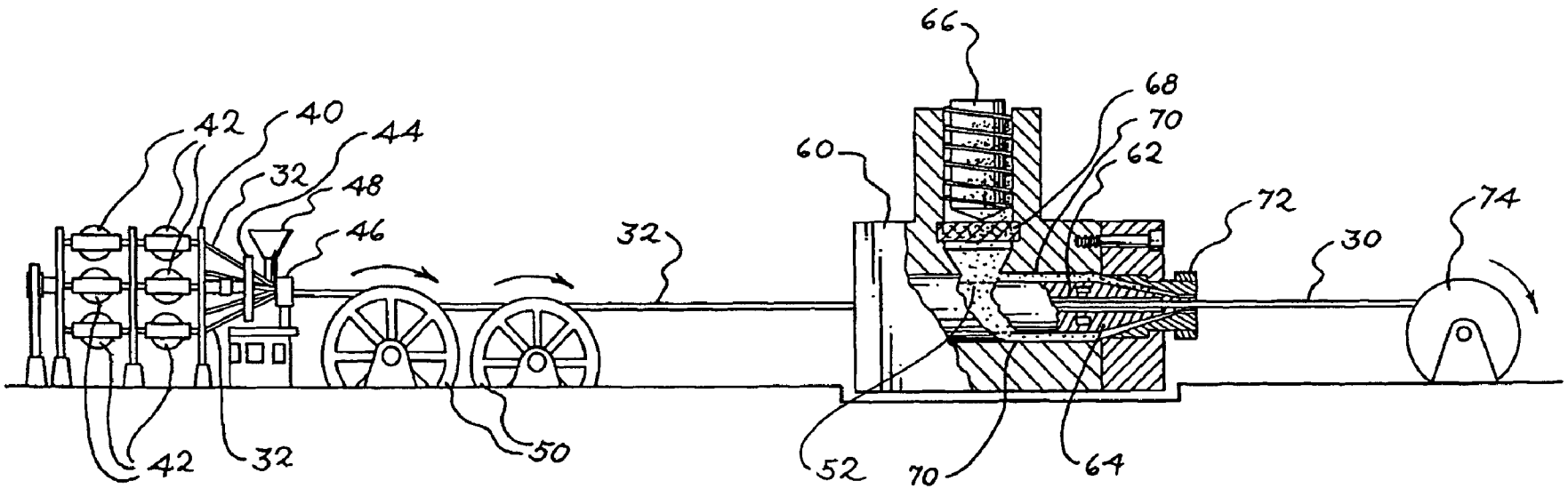
FIG. 2 is a schematic drawing containing a partial cutaway illustration of an in-line apparatus for making the strands of the present invention.

Referring to FIG. 2, individual strand wires 32 are fed from a plurality of strand wire bobbins 42 on a cage-type planetary strander 40 through strand guide plate 44 into strand closing die 46. Strand guide plate 44 and strand closing die 46 are shaped and sized appropriately to control and arrange the desired configuration of the individual strand wires 32 as they are closed and combined together as set forth below. Strand lubricant feeder 48 applies a lubricant such as petrolatum to the individual strand wires 32 preferably prior to entry into the strand closing die 46. Preferably, each of the individual strand wires 32 are fed into strand closing die 46 at substantially the same tension, controlled by using one or more micro-tension controllers (not illustrated) as known in the art.

Strand closing die 46 rotates and helically twists, closes, and thereby combines together the individual strand wires 32 as they pass through strand closing die 46. The speed of rotation of strand closing die 46 relative to the speed that the individual strand wires 32 pass through the cage-type planetary strander 40 is calibrated depending upon the desired tightness of the helix configuration of the combined individual strand wires 32. The combined individual strand wires 32 and associated lubricant are conveyed over capstans 50 into strand encapsulation extruder 60.

The combined individual strand wires 32 and associated lubricant are conveyed through central portal 62 of mandrel 64 of strand encapsulation extruder 60. Extruder screw 66 forces raw resin material 52 through screen breaker plate 68 into circumferential passage 70 surrounding mandrel 64 of encapsulation extruder 60. The raw resin material 52 is forced by extruder screw 66 under pressure through circumferential passage 70 surrounding the mandrel 64 that, in turn, surrounds the combined individual strand wires 32 and associated lubricant passing through the central portal 62 of mandrel 64. The raw resin material 52 is conveyed through circumferential passage 70 which converges at heater band 72. Heater band 72 heats the raw resin material 52 to the melting point of the raw resin material 52 which, upon emerging from strand encapsulation extruder 60, quickly cools, solidifies to form the strand encapsulating material 34 (see FIG. 1), and tightly surrounds the outer circumference of the combined individual strand wires 32 together with the associated lubricant as, referring to FIG. 2, they emerge from central portal 62 of strand encapsulation extruder 60. Because the heater band 72 is preferably positioned proximate to the end of central portal 62 from which individual strand wires 32 emerge from strand encapsulation extruder 60, and because the strand encapsulating material 34 surrounds and seals the lubricant and associated combined strand wires 32 as they emerge from central portal 62, whatever heating of the strand lubricant occurs from heating band 72 does not cause the lubricant to become substantially disassociated from individual strand wires 32 due to the sealing properties of strand encapsulating material 34 relative to the individual strand wires 32 and associated lubricant. The strand 30 thus created is then wound around strand take-up spool 74. Preferably, a plurality of strands 30 on a plurality of strand take-up spools 74 are created in this manner.

Figure 3:
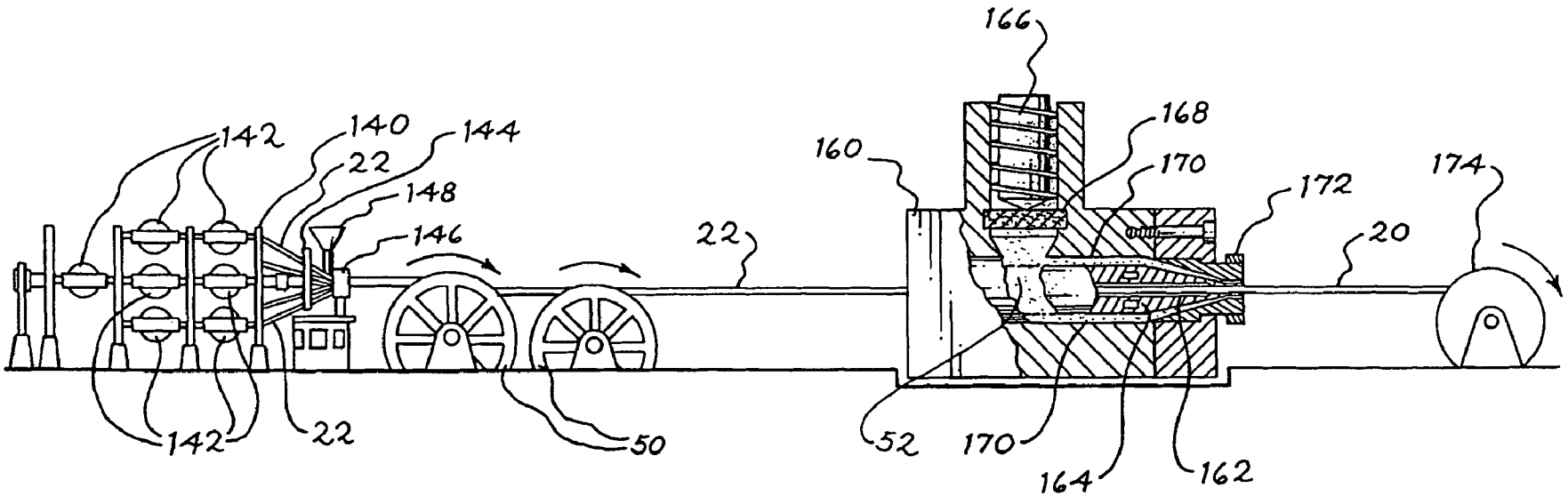
FIG. 3 is a schematic drawing containing a partial cutaway illustration of an in-line apparatus for making the independent wire rope core of the present invention.

In a similar manner, referring to FIG. 3, individual core wires 22 are fed from a plurality of core wire bobbins 142 on a cage-type planetary strander 140 through core guide plate 144 into core closing die 146. Core guide plate 144 and core closing die 146 are shaped and sized so as to control and arrange the desired configuration of the individual core wires 22 as they are closed and combined together. A core lubricant feeder 148 applies a lubricant, preferably petrolatum, to the individual core wires 22, preferably prior to entry into core closing die 146. Each of the individual core wires 22 are preferably fed into core closing die 146 at substantially the same tension, controlled by using micro-tension controllers (not illustrated) as are known in the art.

The core closing die 146 rotates and thereby helically twists, closes, and combines together the individual core wires 22 as they pass through core closing die 146. The speed of rotation of core closing die 146 relative to the speed that the individual core wires 22 pass through the cage-type planetary strander 140 is calibrated to produce a desired tightness of the helix configuration of the combined individual core wires 22. The combined individual core wires 22 and associated lubricant are conveyed over capstans 50 into core encapsulation extruder 160.

The combined lubricated individual core wires 22 are conveyed through central portal 162 of mandrel 164 of core encapsulation extruder 160. Extruder screw 166 forces raw resin material 52 through screen breaker plate 168 and into the circumferential passage 170 surrounding the mandrel 164 of core encapsulation extruder 160. Under pressure from the extruder screw 166, the raw resin material 52 surrounds mandrel 164, and, in turn, the combined lubricated individual core wires 22. The raw resin material 52 is conveyed through circumferential passage 170 and converges at heater band 172, which heats the raw resin material 52 to the melting point of the raw resin material 52. Upon emerging from core encapsulating extruder 160, the melted raw resin material 52 immediately cools, solidifies to form core encapsulating material 24 (see FIG. 1), and tightly surrounds the combined lubricated individual core wires 22 and associated lubricant as, referring to FIG. 3, they emerge from central portal 162 of core encapsulation extruder 160. The heater band 172 is preferably positioned proximate to the end of central portal 162 from which the individual core wires 22 emerge. Because the core encapsulating material 24 surrounds and seals the combined individual core wires 22 and the associated lubricant as they emerge from central portal 162, any heating of the lubricant associated with combined individual core wires 22 by heating band 172 does not cause the lubricant to become substantially disassociated from individual core wires 22 during manufacture. The independent wire rope core 20 thus created is wound around core take-up spool 174.

Having made independent wire rope core 20 wound on core take-up spool 174, and a plurality of strands 30 wound on strand take-up spools 74, the wire rope 10 can then be manufactured.

Figure 4:
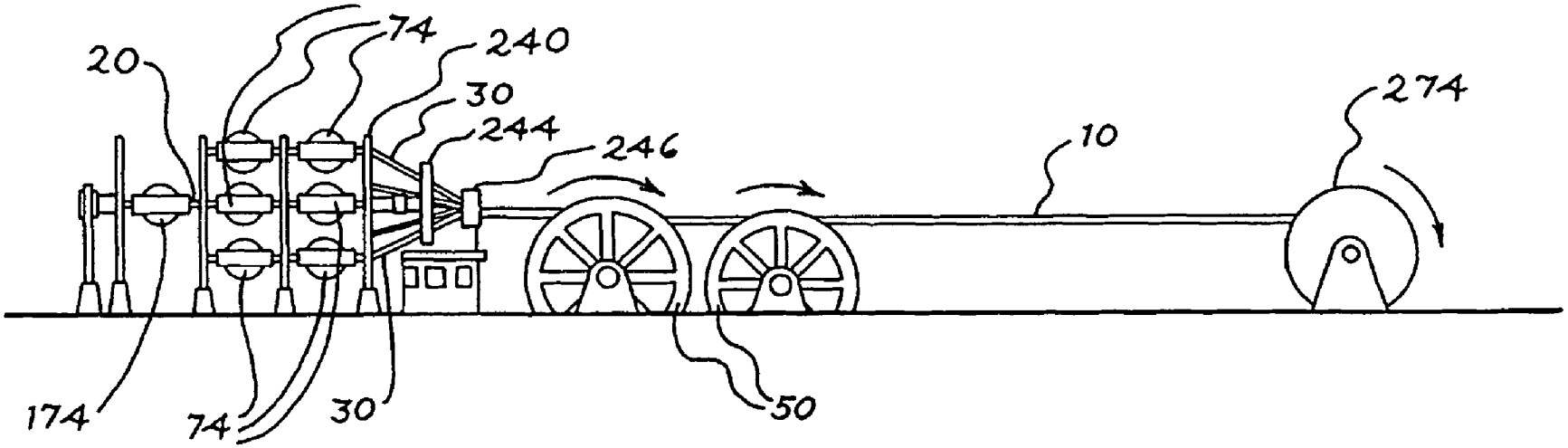
FIG. 4 is a schematic drawing of an in-line apparatus for combining the strands and independent wire rope core into the wire rope of the present invention.

Referring to FIG. 4, independent wire rope core 20 on core take-up spool 174, and a plurality of strands 30 on strand take-up spools 74 are mounted on cage-type planetary strander 240. Independent wire rope core 20 is fed through a central aperture (not illustrated) in wire rope guide plate 244 into wire rope closing die 246. Strand wires 30 are fed through radially spaced apertures (not illustrated) in wire rope guide plate 244 into wire rope closing die 246. Preferably, each of the strands 30 and the independent wire rope core 20 are fed into the wire rope closing die 246 at substantially the same tension using one or more micro-tension controllers (not illustrated) known in the art.

Wire rope closing die 246 rotates, twisting the strands 30 around the independent wire rope core 20, as they pass through wire rope closing die 246, but not twisting independent wire rope core 20 which passes through a central aperture in wire rope closing die 246, thereby closing and combining the strands 30 helically around the independent wire rope core 20. The speed of rotation of the wire rope closing die 246 relative to the speed that the strands 30 and independent wire rope core 20 pass through the cage-type planetary strander 240 is calibrated depending upon the desired tightness of the helix configuration formed by the strands 30 twisted around the independent wire rope core 20. Upon closing, wire rope 10 is formed and is wound around wire rope take-up spool 274.

The in-line process for manufacturing wire rope 10 of the invention serves to promote the economic manufacture of wire rope 10, further helping to achieve the benefits sought to be accomplished by the invention.

For the reasons discussed above, the wire rope 10 of the present invention improves upon prior art wire ropes in a number of ways that significantly improve the useful life of the wire rope 10, particularly when used in heavy duty applications such as large electric shovels (such as the 100 ton shovels discussed above) or in dragline applications in mining operations.

By significantly increasing the useful life, wire rope 10 of the present invention creates a number of economies associated with the operation of the equipment utilizing the wire rope. First, because the wire rope 10 of the present invention has a significantly improved useful life (currently predicted to be at least 2000 hours, or more than twice the observed useful life of wire ropes made according to U.S. Pat. No. 6,360,522 in comparable uses), the wire rope 10 of the present invention will have to be replaced significantly less often than prior art wire ropes (predicted to be replaced half as often as prior art wire ropes made according to U.S. Pat. No. 6,360,522). This leads to savings on the purchase of replacement wire ropes 10.

Second, because the wire rope 10 of the present invention has to be replaced significantly less often, the large piece of capital equipment in which the wire rope 10 may be utilized (such as a large, 100 ton capacity electric shovel) is idled for wire rope replacement or maintenance far less often, and thereby remains productive more often, than the same equipment using prior art wire ropes. For example, if the wire rope 10 of the present invention is replaced every 2000 hours on average (3.75 replacements per year, times 5 to 8 hours per replacement), comparing that to prior art rope made according to U.S. Pat. No. 6,360,522 in a large electric shovel used in a mining operation (7.83 replacements per year, times 5 to 8 hours per replacement), then the large electric shovel would remain in operation and be productive an average of approximately 20.40 hours to 32.64 more hours per year per electric shovel, a substantial production increase to the owner/operator of the mining equipment based upon decreased wire rope replacement time alone.

Third, to the extent that the relative inaccessibility or remoteness of the equipment utilizing the wire rope 10 of the present invention (a typical problem, for example, in mining operations) complicates and adds further expense to maintenance and replacement required by the wire rope 10, the significant extension of the useful life of the wire rope 10 of the present invention aids in substantially combating any such additional expenses attributable to inaccessibility or remoteness.

While the above dimensions and materials have been found to be useful and preferable particularly in certain applications utilizing the invention in connection with hoisting apparatus for large electric shovels and dragline operations in mining, skilled practitioners will recognize that other combinations of dimensions and materials can be utilized without departing from the invention claimed herein. Moreover, although certain embodiments of the invention have been described by way of example, it will be understood by skilled practitioners that modifications may be made to the disclosed embodiments without departing from the scope of the invention, which is defined by the claims.

Having thus described exemplary embodiments of the invention, that which is desired to be secured by Letters Patent is claimed below.

I claim:

1. A wire rope comprising:

(A) A central wire rope axis extending substantially the length of the wire rope through the cross-sectional center of the wire rope in a substantially axial direction, with the wire rope having a radial direction, and with the radial direction of the wire rope being substantially transverse to the central wire rope axis;

(B) An independent wire rope core having a central core axis extending in a substantially axial direction through the cross-sectional center of the independent wire rope core, wherein said central core axis substantially coincides with and is substantially coextensive with said central wire rope axis, with the independent wire rope core having a radial direction, with the radial direction of the independent wire rope core being substantially transverse to the axial direction of the central core axis, and with the independent wire rope core having an outer circumference;

(C) Said independent wire rope core including a plurality of individual core wires arranged about said central core axis, wherein the individual core wires are twisted together and coated with a core lubricant;

(D) The independent wire rope core further including core encapsulating material, wherein the core encapsulating material is substantially tubular in shape, wherein the core encapsulating material has an inner surface and an outer surface, and wherein the outer surface of the core encapsulating material forms the outer circumference of the independent wire rope core and the inner surface of the core encapsulating material surrounds the twisted individual core wires and the core lubricant coating the twisted individual core wires;

(E) A plurality of strands located radially outwardly from the central core axis and the independent wire rope core, with the plurality of strands being adjacent to the independent wire rope core;

(F) Each of the strands having an outer circumference and including a plurality of individual strand wires that are twisted together, wherein the twisted individual strand wires are coated with a strand lubricant;

(G) Each of the strands further including strand encapsulating material, wherein the strand encapsulating material is substantially tubular in shape, wherein the strand encapsulating material has an inner surface and an outer surface, and wherein the outer surfaces of the strand encapsulating material form the outer circumferences of the strands and the inner surfaces of the strand encapsulating material surround the twisted individual strand wires and the strand lubricant coating the individual strand wires;

(H) The outer surface of the strand encapsulating material contacting the outer surface of the core encapsulating material; and (I) Wherein the wire rope does not further include wire rope encapsulating material located radially outward of the strands and simultaneously encapsulating both the wire rope core and the strands.

2. The wire rope of claim 1 wherein the core lubricant and the strand lubricant both are petrolatum.

3. The wire rope of claim 1 wherein the core encapsulating material and the strand encapsulating material both are made from elastomeric or polymeric material.

4. The wire rope of claim 1 wherein the core encapsulating material and the strand encapsulating material both are made from an elastomeric or polymeric material having a compressive strength of 25,000 pounds or more per square inch.

5. The wire rope of claim 1 wherein the core encapsulating material and the strand encapsulating material both are made from polyester.

6. The wire rope of claim 1 wherein the individual core wires are made from steel, and the individual strand wires are made from steel.

7. The wire rope of claim 1 wherein the individual core wires and the individual strand wires both are made from a material chosen from the group consisting of: improved plow steel, and extra improved plow steel.

8. The wire rope of claim 6 wherein the individual core wires and the individual strand wires are bright round steel wires.

9. The wire rope of claim 7 wherein the individual core wires and individual strand wires are compacted steel wires.

10. The wire rope of claim 1 wherein the number of strands in the wire rope is 6 through 8 strands.

11. The wire rope of claim 1 wherein:

(A) The individual core wires and the individual strand wires are made from steel;

(B) The core encapsulating material and the strand encapsulating material both are made from an elastomeric or polymeric material having a compressive strength of 25,000 pounds or more per square inch; and (C) The core lubricant and the strand lubricant both are petrolatum.

12. The wire rope of claim 11 wherein the core encapsulating material and the strand encapsulating material both are made from polyester.

13. The wire rope of claim 12 wherein the thickness of the core encapsulating material and the thickness of the strand encapsulating material both are between approximately 1.0 mm and 3.6 mm.

14. The wire rope of claim 1 wherein the core encapsulating material and the strand encapsulating material are both made from optically transparent elastomeric or polymeric material.

15. The wire rope of claim 1 wherein the strand encapsulating material is made from optically translucent elastomeric or polymeric material having a color chosen from a group consisting of: fluorescent yellow, fluorescent light green, or fluorescent lime-yellow.

16. The wire rope of claim 11 wherein the core encapsulating material and the strand encapsulating material are both made from optically transparent or translucent polyester.

17. The wire rope of claim 16 wherein the strand encapsulating material is made from optically translucent polyester having a color chosen from a group consisting of: fluorescent yellow, fluorescent light green, or fluorescent lime-yellow.

18. An inline method of making a wire rope comprising the steps of:

(A) Forming an independent wire rope core by the steps of:

(i) Coating individual core wires with a core lubricant prior to combining the individual core wires;

(ii) Combining a plurality of individual core wires by using a planetary strander to feed the individual core wires through a core guide plate into a core closing die, and wherein the core closing die rotates and thereby helically twists, closes, and combines together the individual core wires as the individual core wires are fed through the core closing die, with the combined twisted individual core wires having an outer surface;

(iii) Providing a tube of core encapsulating material in a manner so as to surround the outer surface of the combined twisted individual core wires and the core lubricant, wherein the core encapsulating material has an inner surface and an outer surface, and wherein the core encapsulating material is provided so as to seal the core lubricant and the combined twisted individual core wires prior to substantial disassociation of the core lubricant from the combined twisted individual core wires;

(B) Forming a plurality of strands, with each strand being formed by the steps of:

(i) Coating individual strand wires with a strand lubricant prior to combining the individual strand wires;

(ii) Combining a plurality of individual strand wires by using a planetary strander to feed the individual strand wires through a strand guide plate into a strand closing die, and wherein the strand closing die rotates and thereby helically twists, closes, and combines together the individual strand wires as the individual strand wires are fed through the strand closing die, with the combined twisted individual strand wires having an outer surface;

(iii) Providing tubes of strand encapsulating material in a manner so as to surround the outer surfaces of the combined twisted individual strand wires and the strand lubricant of each of the strands, wherein the strand encapsulating material has an inner surface and an outer surface, and wherein the strand encapsulating material is provided so as to seal the strand lubricant and the combined twisted individual strand wires prior to substantial disassociation of the strand lubricant from the combined twisted individual strand wires; and (C) Forming the independent wire rope core and the plurality of strands into a wire rope by the steps of:

(i) Combining the independent wire rope core and the plurality of strands using a planetary strander to feed the independent wire rope core through a central aperture in a wire rope guide plate and to feed the plurality of strands through radially spaced apertures in the wire rope guide plate into a wire rope closing die, and wherein the wire rope closing die rotates and thereby helically twists, closes, and combines together the plurality of strands and the independent wire rope core as the plurality of strands and the independent wire rope core are fed through the wire rope closing die, wherein the plurality of strands are arranged radially outwardly from the independent wire rope core, with the outer surface of the strand encapsulating material of each of the strands contacting the outer surface of the core encapsulating material of the independent wire rope core, and with the strands being twisted helically around the independent wire rope core and adjacent to the independent wire rope core to be combined with the independent wire rope core to form a wire rope; and (ii) Wherein the wire rope so formed has no further wire rope encapsulating material located radially outwardly of the strands and encapsulating both the wire rope core and the strands.

19. The method of making the wire rope of claim 18 wherein the core lubricant and the strand lubricant both are petrolatum.

20. The method of making the wire rope of claim 18 wherein the core encapsulating material and the strand encapsulating material both are made from a material having a compressive strength of 25,000 pounds or more per square inch, and both the core encapsulating material and the strand encapsulating material are made from an elastomeric or polymeric material.

21. The method of making the wire rope of claim 18 wherein the core encapsulating material and the strand encapsulating material both are made from polyester.

22. The method of making the wire rope of claim 18 wherein the individual core wires and the individual strand wires are made from steel.

23. The method of making the wire rope of claim 18 wherein the individual core wires and the individual strand wires are made from a material chosen from the group consisting of: improved plow steel and extra improved plow steel.

24. The method of making the wire rope of claim 18 wherein the individual core wires and the individual strand wires are bright round steel wires.

25. The method of making the wire rope of claim 18 wherein the individual core wires and the individual strand wires are compacted steel wires.

26. The method of making the wire rope of claim 18 wherein the number of strands is 6 through 8 strands.

27. The method of making the wire rope of claim 18 wherein:

(A) The individual core wires and the individual strand wires are made from steel;

(B) The core encapsulating material and the strand encapsulating material both are made from an elastomeric or polymeric material having a compressive strength of 25,000 pounds or more per square inch; and (C) The core lubricant and the strand lubricant both are petrolatum.

28. The method of making the wire rope of claim 27 wherein the core encapsulating material and the strand encapsulating material both are made from polyester.

29. The method of making the wire rope of claim 28 wherein the thickness of the core encapsulating material and the thickness of the strand encapsulating material both are between approximately 1.0 mm and 3.6 mm.

30. The method of making the wire rope of claim 18 wherein the strand encapsulating material is made from optically transparent polyester.

31. The method of making the wire rope of claim 18 wherein the strand encapsulating material is made from optically translucent polyester having a color chosen from a group consisting of: fluorescent yellow, fluorescent light green, or fluorescent lime-yellow.

32. The method of making the wire rope of claim 27 wherein the strand encapsulating material is made from optically transparent polyester.

33. The method of making the wire rope of claim 27 wherein the strand encapsulating material is made from optically translucent polyester having a color chosen from a group consisting of: fluorescent yellow, fluorescent light green, or fluorescent lime-yellow.

34. The method of making the wire rope of claim 18 wherein:

(A) Each of the individual core wires are fed into the core closing die at substantially the same tension;

(B) Each of the individual strand wires are fed into the strand closing die at substantially the same tension; and (C) Each of the strands and the independent wire rope core are fed into the wire rope closing die at substantially the same tension.

35. The method of making the wire rope of claim 34 wherein:

(A) The tension at which each of the individual core wires is fed into the core closing die is controlled by using micro-tension controllers;

(B) The tension at which each of the individual strand wires is fed into the strand closing die is controlled by using micro-tension controllers; and (C) The tension at which each of the strands and the independent wire rope core are fed into the wire rope closing die is controlled by using micro-tension controllers.

36. A wire rope comprising:

(A) A central wire rope axis extending substantially the length of the wire rope through the cross-sectional center of the wire rope in a substantially axial direction, with the wire rope having a radial direction, and with the radial direction of the wire rope being substantially transverse to the central wire rope axis;

(B) An independent wire rope core having a central core axis extending in a substantially axial direction through the cross-sectional center of the independent wire rope core, wherein said central core axis substantially coincides with and is substantially coextensive with said central wire rope central axis, with the independent wire rope core having a radial direction, with the radial direction of the independent wire rope core being substantially transverse to the central core axis, and with the independent wire rope core having an outer circumference;

(C) Said independent wire rope core including a plurality of individual core wires arranged about said central core axis, wherein the individual core wires are coated with a core lubricant and twisted together;

(D) The independent wire rope core further including core encapsulating material, wherein the core encapsulating material is substantially tubular in shape, wherein the core encapsulating material has an inner surface and an outer surface, and wherein the outer surface of the core encapsulating material forms the outer circumference of the independent wire rope core and the inner surface of the core encapsulating material surrounds the twisted individual core wires and the core lubricant coating the twisted individual core wires;

(E) A plurality of strands located radially outwardly from the central core axis and the independent wire rope core, with the plurality of strands being adjacent to the independent wire rope core;

(F) Each of the strands having an outer circumference and including a plurality of individual strand wires that are coated with a strand lubricant and are twisted together;

(G) Each of the strands further including strand encapsulating material, wherein the strand encapsulating material is substantially tubular in shape, wherein the strand encapsulating material has an inner surface and an outer surface, and wherein the outer surfaces of the strand encapsulating material forms the outer circumferences of the strands and the inner surfaces of the strand encapsulating material surrounds the twisted individual strand wires and the strand lubricant coating the individual strand wires;

(H) Wherein the outer surface of the strand encapsulating material contacts the outer surface of the core encapsulating material;

(I) Wherein the wire rope does not further include wire rope encapsulating material located radially outwardly of the strands and simultaneously encapsulating both the wire rope core and the strands;

(J) Wherein the core encapsulating material and the strand encapsulating material are made from polyester; and (K) Wherein the core encapsulating material is either optically transparent or translucent and the strand encapsulating material is either optically transparent or translucent.

37. The wire rope of claim 36 wherein:

(A) The core lubricant and the strand lubricant both are petrolatum;

(B) All of the individual core wires are made from a material chosen from the group consisting of: steel, improved plow steel, extra improved plow steel, compacted steel, or bright round steel wires; and (C) The number of strands in the wire rope is 6 through 8 strands.

38. The wire rope of claim 37 wherein the core encapsulating material is optically transparent.

39. The wire rope of claim 37 wherein the core encapsulating material is optically translucent and has a color chosen from a group of colors consisting of: fluorescent yellow, fluorescent light green, and fluorescent lime-yellow.

* * * * *